United States Patent [19]

Czech

[11] Patent Number: 5,049,229

[45] Date of Patent: Sep. 17, 1991

[54] APPARATUS FOR THE APPLICATION OF AN ADHESIVE FILM

[75] Inventor: Manuel Czech, Donaustauf, Fed. Rep. of Germany

[73] Assignee: Czewo Plast Kunststofftechnik GmbH, Neutraubling, Fed. Rep. of Germany

[21] Appl. No.: 456,511

[22] Filed: Dec. 26, 1989

[30] Foreign Application Priority Data

Jan. 4, 1989 [DE] Fed. Rep. of Germany ..... 3900156

[51] Int. Cl.[5] ..... B32B 35/00

[52] U.S. Cl. ..... 156/577; 156/574; 156/579; 156/584; 242/193

[58] Field of Search ..... 156/527, 577, 579, 584, 156/574; 242/193, 194; 310/103; 192/28, 415, 46

[56] References Cited

U.S. PATENT DOCUMENTS

| | | | |
|---|---|---|---|
| 3,893,757 | 7/1975 | Donnici | 242/194 X |
| 4,145,016 | 3/1979 | Wiig | 242/193 |
| 4,152,617 | 5/1979 | Janson | 310/103 |
| 4,324,603 | 4/1982 | Crandall et al. | 156/577 X |
| 4,347,006 | 8/1982 | Shakib | 192/28 X |
| 4,486,258 | 12/1984 | Schrotz | 156/577 X |
| 4,601,775 | 7/1986 | Grone | 156/574 X |
| 4,648,935 | 3/1987 | Brown et al. | 156/579 X |
| 4,851,076 | 7/1989 | Manusch et al. | 156/577 |

*Primary Examiner*—David A. Simmons
*Assistant Examiner*—J. Sells
*Attorney, Agent, or Firm*—Nilles & Nilles

[57] ABSTRACT

An apparatus for the application to a substrate of an adhesive film initially adhering to a carrier tape provided in the form of a coil comprises an applicator (23; 123) by means of which the adhesive film (3; 103) is peeled of the carrier tape (4; 104) as the latter is moved therepast. A takeup reel (11; 111) is provided for rewinding the carrier tape (4; 104) after it has passed the applicator (23; 123), there being an operative connection (13; 113) provided between the takeup reel (11; 111) and the carrier tape coil (7; 107). The apparatus (1) for the application of the adhesive film is characterized in that the diameter of the takeup reel (11; 111) is at least as great as the greatest possible diameter of the carrier tape coil (7; 107), that the takeup reel (11; 111) and the carrier tape coil (7; 107) are disposed on a common axis (9; 109) and that the operative connection is designed as a disc clutch (13; 113). The disc clutch (13; 113) is preferably designed as a magnetic clutch (19, 21; 119, 121).

29 Claims, 7 Drawing Sheets

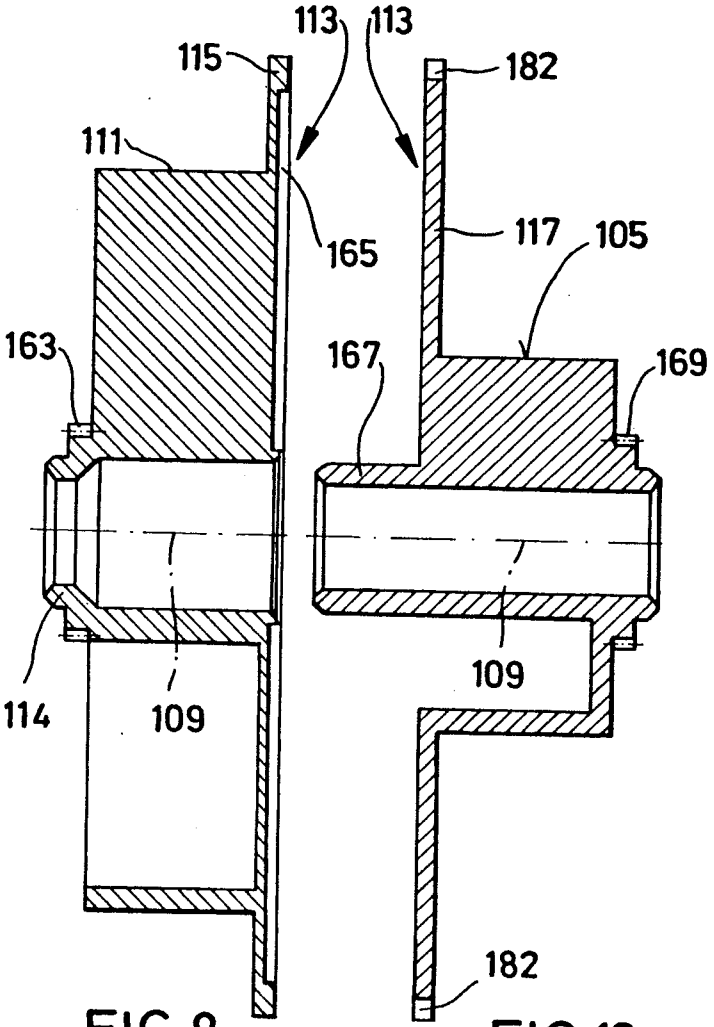
FIG.10
FIG.8
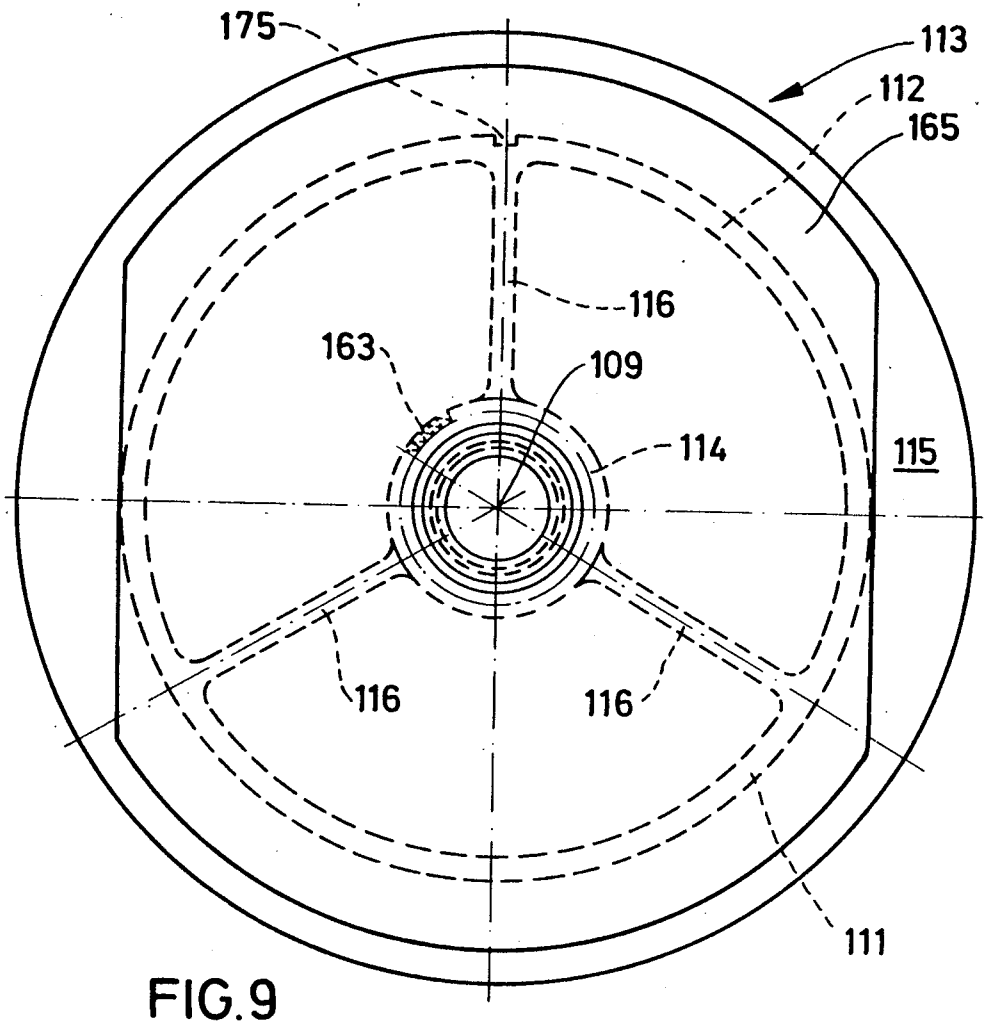
FIG.9

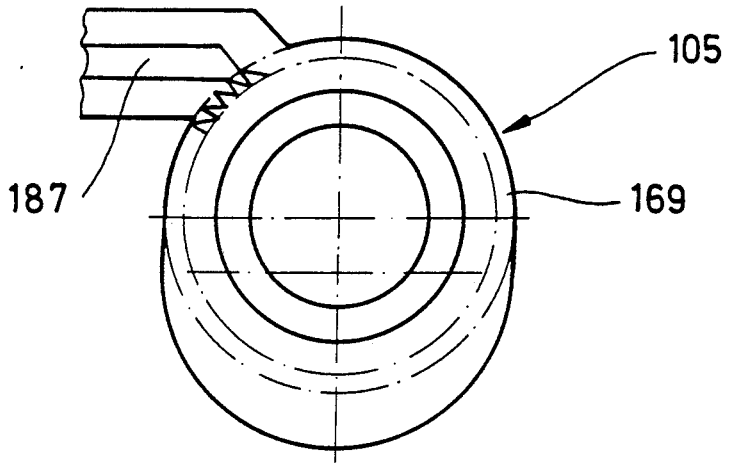
FIG.16
FIG.17
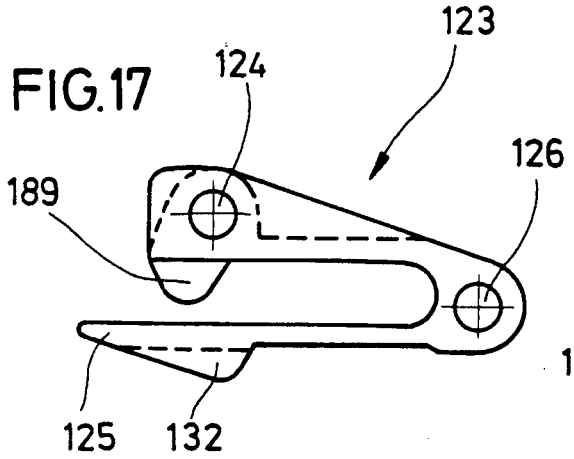
FIG.18
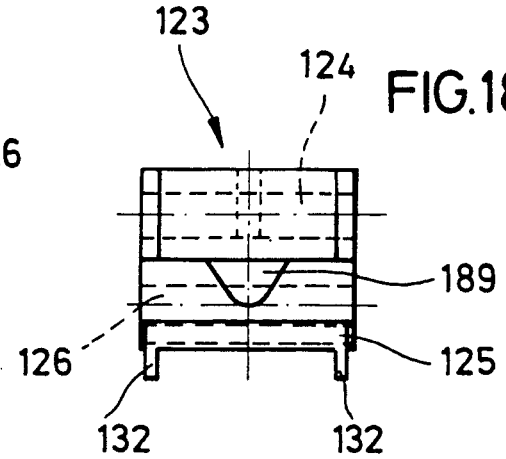
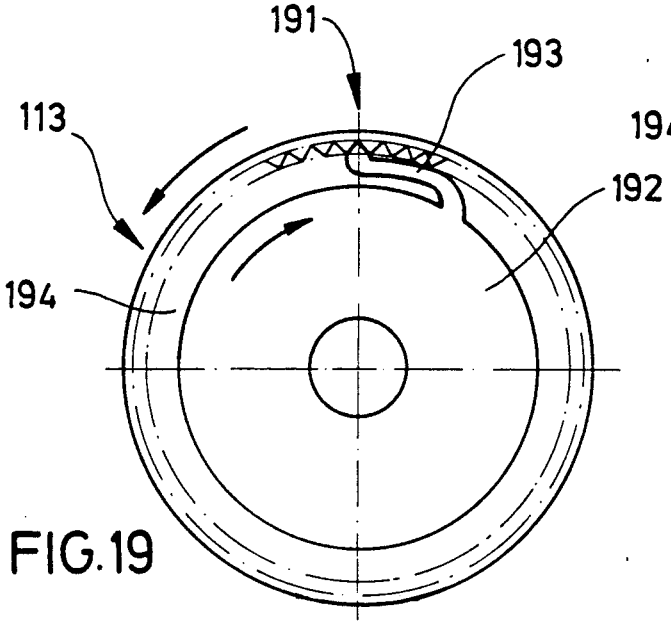
FIG.19
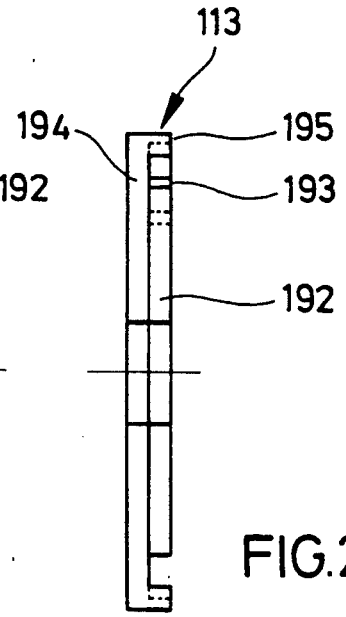
FIG.20

APPARATUS FOR THE APPLICATION OF AN ADHESIVE FILM

BACKGROUND OF THE INVENTION

The present invention relates to an apparatus for the application of an adhesive film.

The application of an adhesive film to a substrate may be accomplished by known devices in which the adhesive film initially adheres to a carrier tape wound onto a coil from which it is withdrawn and guided over an applicator for applying the adhesive film onto the substrate. The empty carrier tape is then wound onto a takeup reel downstream of the applicator. Between the takeup reel and the carrier tape coil there is provided an operative connection in the form of a pair of meshing gears, at least one of these gears being mounted on its respective shaft in a manner permitting slippage to occur between the gear and its shaft.

A disadvantage of this apparatus results from the rather complicated design of the geared connection, with the consequent increase of the dimensions of the device, the handling of the apparatus or device being additionally hampered by an uneven and erratic distribution of weights caused by the change of the respective coil sizes.

SUMMARY OF THE INVENTION

It is therefore an object of the present invention to provide an apparatus of the type defined in the introduction, useful for the application of an adhesive film to a substrate, and being of simple construction and small dimensions for facilitating its handling.

This object is attained by the provisions set forth in the characterizing clause of claim 1.

As a result of the provisions that the diameter of the still empty takeup reel is at least as great as the greatest possible diameter of the carrier tape coil, that the takeup reel and the carrier tape coil are disposed on a common axis, and that the operative connection is formed by a disc clutch, the takeup reel is operatively connected to the carrier tape coil in the simplest possible manner, at the same time resulting in a favourable weight distribution and reduced dimensions of the apparatus as a whole.

The handling of the apparatus according to the invention is still further facilitated by the provision that the two rotatable reels or coils are disposed on a common axis, whereby the action thereon of torques from different directions is avoided.

Further advantageous embodiments and features of the invention are apparent from the subclaims.

In a preferred embodiment of the invention the disc clutch may be provided with friction discs permitting slippage to occur between the clutch components. Alternatively the clutch may also be designed as a ratchet clutch or a detent spring clutch.

Another advantageous and substantially wear-resistant embodiment of the disc clutch is in the form of a magnetic clutch composed for instance of a magnetic sheet member and a steel sheet member.

A particularly simple feeding of the carrier tape and return thereof from the applicator to the takeup reel may be accomplished by the provision of a return guide pin. A particularly smooth and simple return of the empty carrier tape is achieved by the employ of two return guide pins. To this purpose the two return guide pins may be disposed at spaced locations above the carrier tape coil and the takeup reel. The spacing between the two return guide pins in this case is preferably substantially equal to the outer diameter of the carrier tape coil in its yet not unwound state.

For guiding the carrier tape in a particularly smooth and effective manner, additional return guide pins may be provided, for instance a total of three return guide pins forming two pairs disposed substantially in respective planes extending substantially perpendicular to one another. In particular, this arrangement makes it possible that the outgoing and the returning runs of the carrier tape are withdrawn from and guided onto the respective coils at approximately the same location, i.e. in a plane extending perpendicular to the direction of the outgoing and returning runs, respectively. This results in the advantage that the traction forces exerted by the carrier tape act on the respective coils substantially at the same location, so that a differential torque can only be brought about by different lever arm lengths. This results in a particularly smooth operation of the apparatus.

When the return guide pins are disposed at different angles, the carrier tape is guided in a particularly smooth and effective manner from the unwinding location to the rewinding location. The return guide pins may additionally be rotatable or designed as return guide pulleys to thereby ensure effortless feeding of the carrier tape.

The application apparatus may advantageously be provided with an applicator lip to ensure effective peeling of the adhesive film off the carrier tape. The applicator lip may advantageously be mounted for pivoting in all directions, so that the adhesive film may be applied to a substrate having variable contours without requiring any change in the orientation of the apparatus. The apparatus may thus be manually moved along a straight path in the usual manner for applying the adhesive film to a substrate surface extending at variable levels or inclinations.

For guiding the carrier tape more effectively over the applicator lip, the latter may be provided with lateral tape guide projections.

According to a preferred embodiment of the invention, respective bushings are provided for mounting on each side of the apparatus, one of the bushings having the carrier tape coil mounted thereon, while the other bushing is adapted to have the carrier tape wound thereonto. To this purpose the bushings are non-rotatably mounted.

The takeup reel, the carrier tape coil, the operative connection therebetween and the applicator are preferably housed in a common casing, so that the handling of this combination of the named components is greatly facilitated. The casing and components housed therein may then be designed as a disposable unit.

Again for facilitating the handling of the apparatus, the casing may be pivotably and lockable mounted in a housing, permitting the casing and its contents to be readily replaced after the supply of the adhesive film is exhausted.

Advantageously provided is a first locking means for preventing the carrier tape from being advanced or fed as long as the casing is not in its operative position in the housing. A second locking means may be provided for preventing the carrier tape coil from being inadvertently rotated in the wrong direction, i.e. opposite to the carrier tape feeding direction.

BRIEF DESCRIPTION OF THE DRAWINGS

Further details, advantages and characteristics of the invention will become apparent from the following description with reference to the accompanying drawings, wherein:

FIG. 8 shows a sectional view of a preferred embodiment of the carrier tape takeup reel, FIG. 9 shows a sideview of the takeup reel from the right in FIG. 8, FIG. 10 shows a sectional view of a preferred embodiment of a supply reel, FIG. 16 shows a preferred embodiment of second locking means, FIG. 17 shows a sideview of a preferred embodiment of an applicator, FIG. 18 shows the applicator as viewed from the left in FIG. 17, FIG. 19 shows a sideview of a disc clutch in an alternative embodiment, and FIG. 20 shows a front view of the disc clutch depicted in FIG. 19.

DESCRIPTION OF A PREFERRED EMBODIMENT

Figure 1:
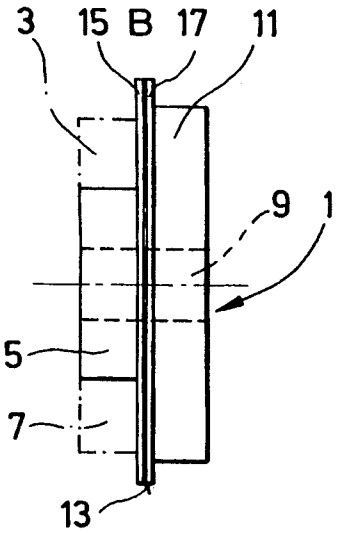
FIG. 1 shows a diagrammatic partial view of an apparatus for the application of an adhesive film according to a first embodiment of the invention, comprising a takeup reel and a carrier tape coil disposed on a common axis.

As shown in FIG. 1, an apparatus 1 according to the invention for the application of an adhesive film 3 comprises a supply reel 5 carrying a coil 7 of a carrier tape 7 to which adhesive film 3 adheres. Supply reel 5 is non-rotatably mounted on an axis or shaft 9 itself mounted in a housing (not shown). Also mounted on shaft 9 in a non-rotatable manner is a takeup reel 11, the outer diameter of which in its empty state being at least as great as that of the carrier tape coil 7 in its initial, i.e. not yet unwound state. Takeup reel 11 and supply reel 5 are operatively connected to one another by a disc clutch 13 composed of two discs 15 and 17. Discs 15, 17 may for instance be friction discs non-rotatably connected to supply reel 5 and takeup reel 11, respectively, and designed to permit slippage to occur therebetween.

Figure 3:
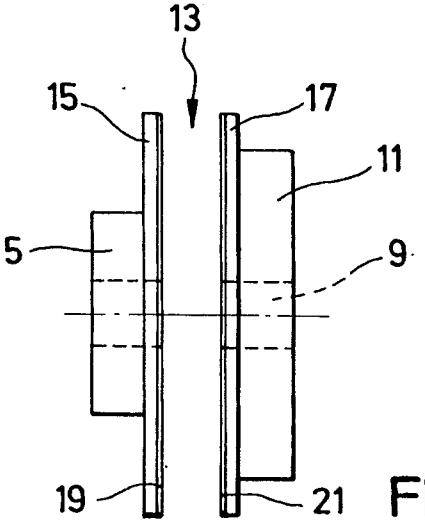
FIG. 3 shows a partial view illustrating the operative connection between the takeup reel and the carrier tape coil in the first embodiment of the invention.

In a preferred embodiment depicted in FIG. 3, disc 15 is provided with a magnetic sheet member 19 on its side facing towards disc 17, the latter being provided with a steel sheet member 21 at its side facing towards disc 15. The combination of the magnetic sheet member with the steel sheet member results in a magnetic clutch offering the particular advantage of a substantially wear-free slip clutch.

Figure 2:
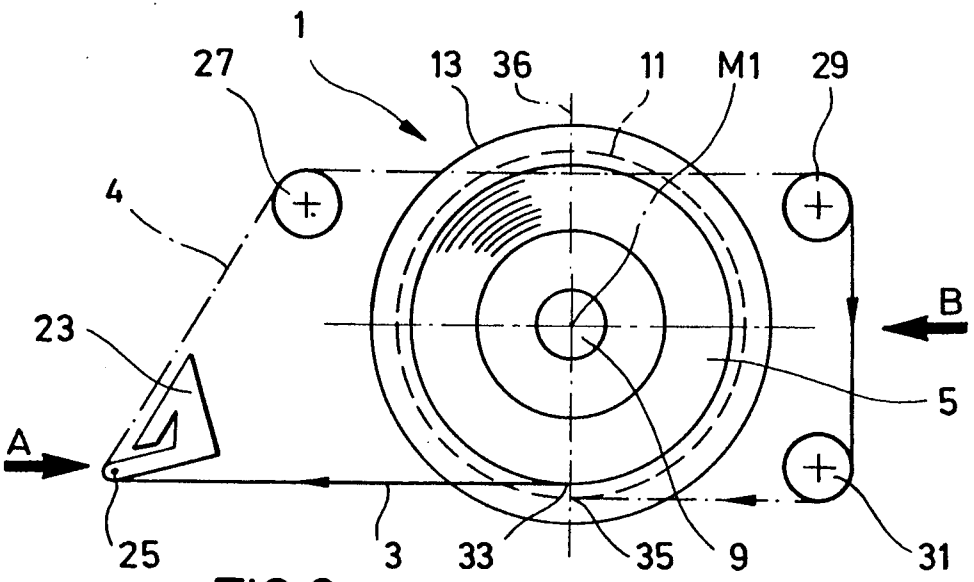
FIG. 2 shows a diagrammatic sideview of the apparatus depicted in FIG. 1.

As shown in FIG. 2, the apparatus according to the invention is provided with an applicator 23 comprising an applicator lip 25 with the aid of which it is possible to readily peel adhesive film 3 off a carrier tape 4 on which it is supported. Carrier tape 4 is guided over a first, a second and a third return guide pulley 27, 29 and 31, respectively, onto takeup reel 11. First and second guide pulleys 27 and 29 and second and thrid pulleys 29 and 31, respectively, are disposed in respective planes extending substantially perpendicular to one another. Proceeding from first guide pulley 27, this results in a substantially rectangular guide path, in which the point 35, whereat carrier tape 4 joins takeup reel 11, lies substantially in the same plane 36 as the point 33, whereat carrier tape 4 is unwound from supply reel 5, this plane 36 being substantially perpendicular to the tangential plane of carrier tape coil 7 and takeup reel 11 adjacent points 33 and 35, respectively. This results in a particularly favourable distribution of traction forces, any differential torques being solely created by the different lengths of the lever arms between the axial centers of the reels and respective rewinding and unwinding points 35 and 33, respectively, the resultant forces acting in opposite directions so as to at least partially cancel one another.

The apparatus according to the invention operates as follows: From a new carrier tape coil 7 mounted on supply reel 5, a sufficient length of carrier tape 4 is withdrawn to extend over applicator 23 and return guide pulleys 27, 29 and 31 to takeup reel 11, and to have its free end secured thereto. The securing step can be accomplished in a simple manner, because the end of carrier tape 4 can be secured to takeup reel 11 by the adhesive film 3 still adhering thereto. The carrier strip may of course be secured to the takeup reel in any other suitable manner, particularly when it has the adhesive film no longer adhering thereto, in which case the takeup reel may be formed with a slot for the insertion of the carrier tape, as generally known from film reels.

Applicator lip 25 of applicator 23 is then deposed onto a substrate to be provided with adhesive film 3. The appartus 1 is then bodily moved in the direction of arrow A, as a result of which carrier tape 4 with adhesive film 3 thereon is unwound from carrier tape coil 7 and rewound onto takeup reel 11, the latter having to rotate at a slower speed than carrier tape coil 7 due to its greater diameter. As a result, however, of the operative connection between takeup reel 11 and carrier tape coil 7 or supply reel 5, respectively, takeup reel 11 initially rotates at the same speed and is subsequently decelerated by the carrier tape secured thereto, so that it then rotates in accordance with the tape unwinding speed. Carrier tape 4 thus exerts a continuous braking action on takeup reel 11 and is thereby kept under tension, permitting it to be smoothly and reliably rewound onto takeup reel 11.

The employ of the magnetic clutch permits any rupture of the adhesive film tape or carrier tape 4 to be substantially avoided.

Figure 4:
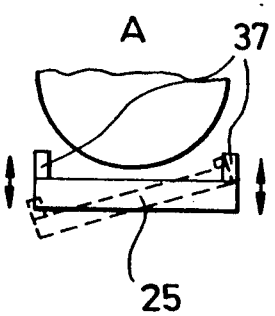
FIG. 4 shows a sideview of an applicator employed in the apparatus according to the invention.

FIG. 4 shows a disgrammatic front view of applicator lip 25 on an enlarged scale. Applicator lip 25 is preferably mounted in a manner permitting it to pivot at least about the longitudinal axis of the tape feed path so as to be readily adaptable to varying substrate contours without requiring the attitude of the apparatus itself to be altered. It is still more preferred to mount applicator lip 25 so as to be pivotable in all directions. For improved guidance of carrier tape 4 applicator lip 25 is provided with lateral guide projections 37 for preventing lateral displacement of the tape.

Return guide pulleys 27, 29 and 31 may be disposed at different angles, whereby carrier tape 4 can be smoothly guided from the unwinding location to the rewinding location, i.e. from carrier tape coil 7 to takeup reel 11.

Figure 5:
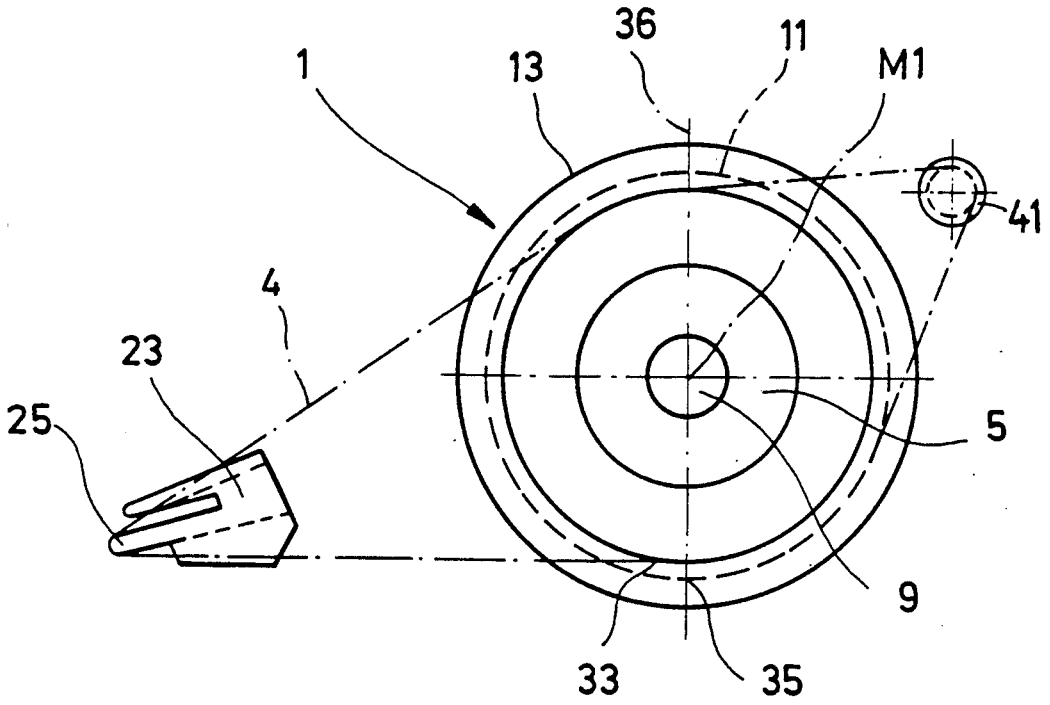
FIG. 5 shows a modification of the first embodiment of the invention using a return guide pulley.

The simplified embodiment illustrated in FIG. 5 is provided with only a single return guide pulley 41 for guiding carrier tape 4 between the unwinding and rewinding locations.

Figure 6:
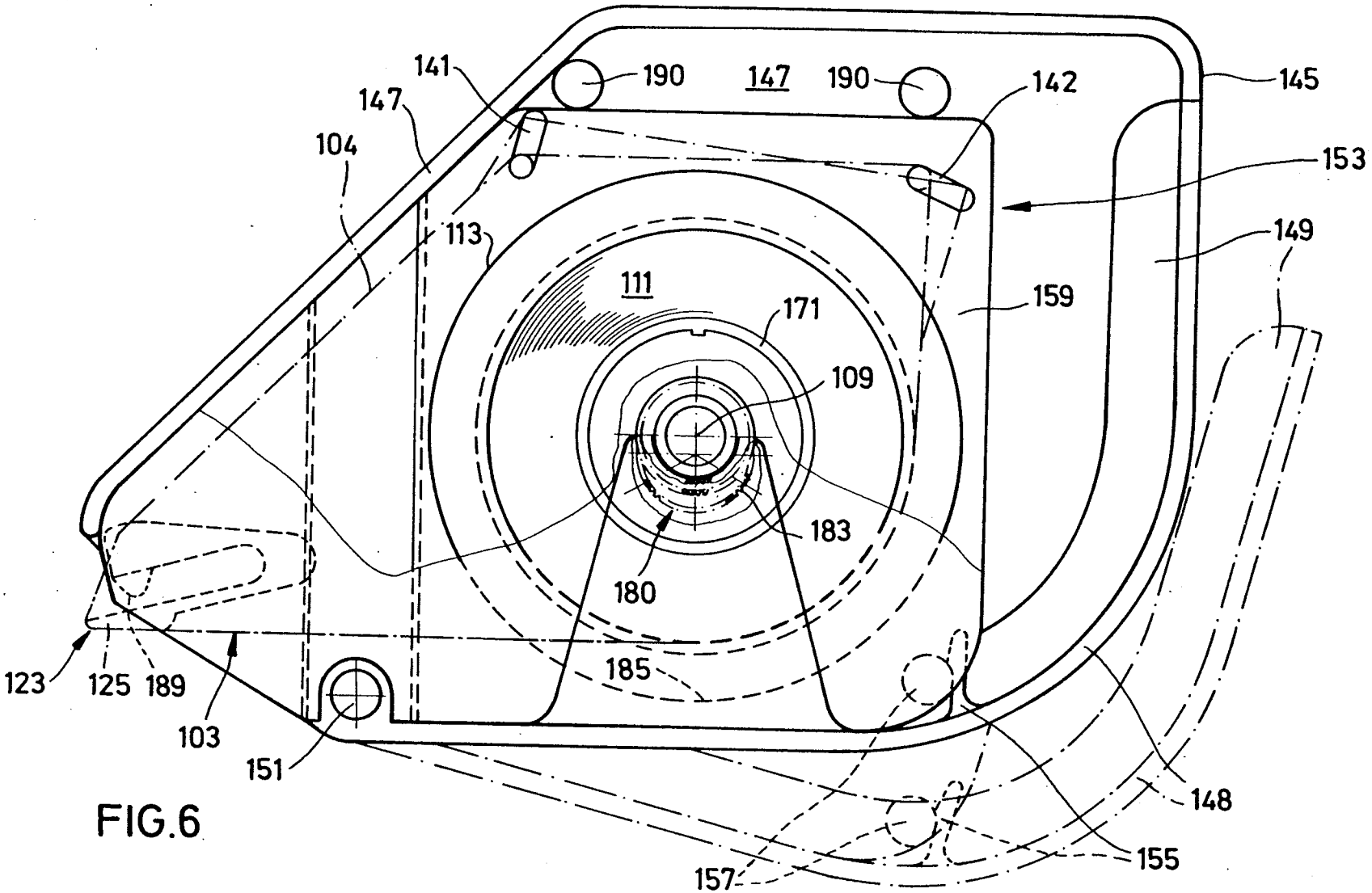
FIG. 6 shows a sideview of a second embodiment of the invention, including a casing and a housing.

FIG. 6 illustrates a preferred second embodiment of the apparatus according to the invention. The apparatus is disposed in a housing 145 having walls 147 between which the apparatus is enclosed. Housing 145 has a lid 149 pivotally mounted about a hinge 151. Lid 149 is preferably pivotable about an angle of 90°. Lid 149 is operable for the insertion of a cartridge or casing 153 and for securing it in position. To this purpose it is provided with a locking pin 155 adapted to be engaged with a transversely extending locking socket extending between lateral walls 159 and 161 of casing 153.

Lid 149 further comprises a transversely extending wall 148 forming a closure of housing 145 in the closed state of lid 149.

Figure 7:
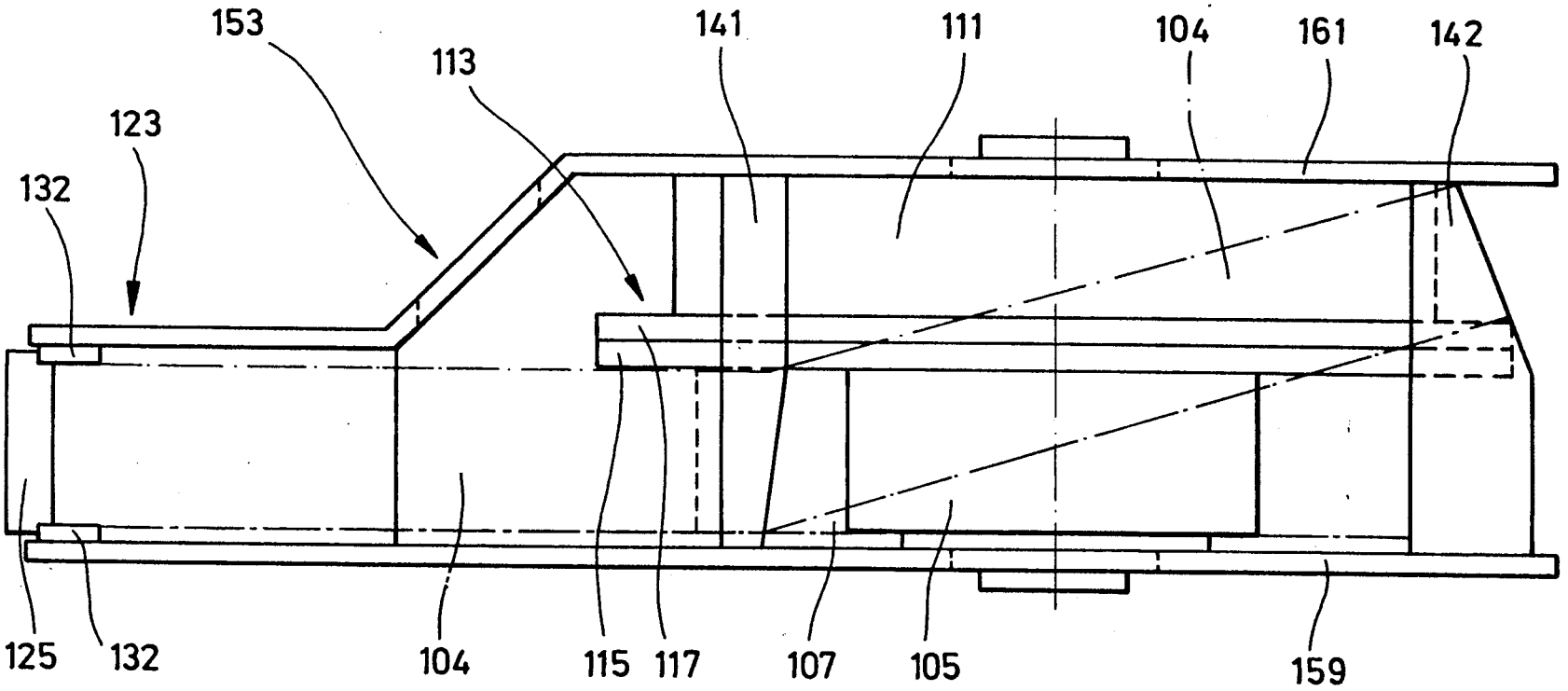
FIG. 7 shows a top plan view of the casing and the components enclosed therein.
Figure 13:
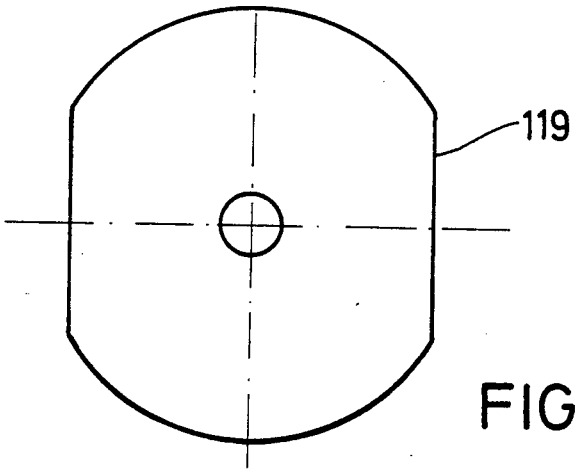
FIG. 13 shows a preferred embodiment of a magnetic sheet member.
Figure 14:
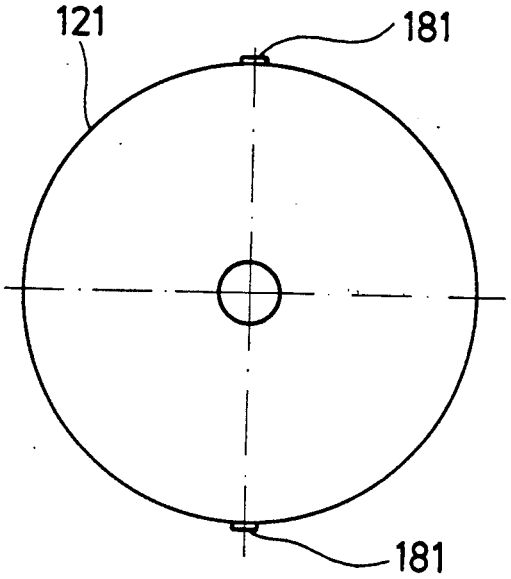
FIG. 14 shows a preferred embodiment of a steel sheet member.
Figure 15:
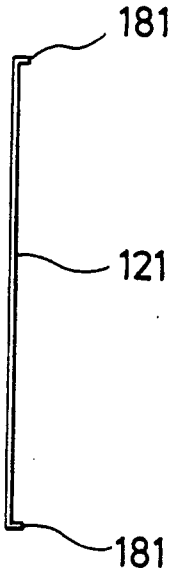
FIG. 15 shows an end view of the steel sheet member depicted in FIG. 14.

Shown in FIG. 7 is a top plan view of casing 153 in which the components of an apparatus for the application of an adhesive film are accommodated. Mounted on a supply reel 105 is a carrier tape coil 107 wherefrom a carrier tape 104 is guided towards an applicator 123, and from there over return guide pins 141 and 142 and onto a takeup reel 111. Return guide pins 141 and 142 may be of a bent configuration with a bending angle of about 45°. Return guide pins 141 and 142 as well as locking socket 157 may at the same time be used for interconnecting casing sidewalls 159 and 161. Alternatively, or in addition thereto, simple plug connections may be provided for permitting casing sidewalls 159 and 161 to be readily connected to one another. Casing 153 is preferably designed as a disposable unit, with sidewalls 159, 161 and pins 141, 142 and 157 made of an inexpensive plastic material. The pins may alternatively also be made of metal. Disposed between supply reel 105 and takeup reel 111 is an operative connection in the form of a disc clutch 113 composed of two discs 115 and 117. Disposed between the two discs in a similar manner as shown in FIGS. 1 and 3 are respective sheet members, namely, a magnetic sheet member 119 and a steel sheet member 121 (cf. FIGS. 13, 14 and 15).

From FIG. 7 it is likewise apparent that the diameter of takeup reel 111 is greater than that of carrier tape coil 107, as a result of which takeup reel 111 always rotates at a slower speed than carrier tape coil 107 during the application of the adhesive film, so that carrier tape 104 is always kept under tension.

FIG. 8 shows a sectional view, and FIG. 9 illustrates a sideview from the right in FIG. 8, of a preferred embodiment of takeup reel 111. As particularly apparent from FIG. 9, takeup reel 111 is of annular configuration with an outer ring 112 surrounding an inner ring 114 and connected thereto by three spokes 116 extending at angular spacings of 120°. The axially outer end of inner ring 114 is formed as a gear 163. A respective disc of disc clutch 113 is integrally formed with takeup reel 111. In the embodiment shown this disc is indicated at 115 and formed with a recess 165 adapted to receive a magnetic sheet member 119 therein. As apparent from FIG. 9, recess 165 is of symmetric configuration defined by two rectiliniear and two arcuate boundaries. In this manner magnetic sheet member 119 can be non-rotatably mounted in recess 165. The inner bore or through-opening of ring 114 is adapted to receive therein a hollow stub shaft 167 of supply reel 105 as illustrated in FIG. 10. Hollow shaft stub 167 is fitted into inner ring 114 in a manner permitting supply reel 105 to be rotated relative to takeup reel 111. The axially outer end of supply reel 105 is again formed with a gear 169 having radial teeth likewise extending in the axial direction.

Figure 11:
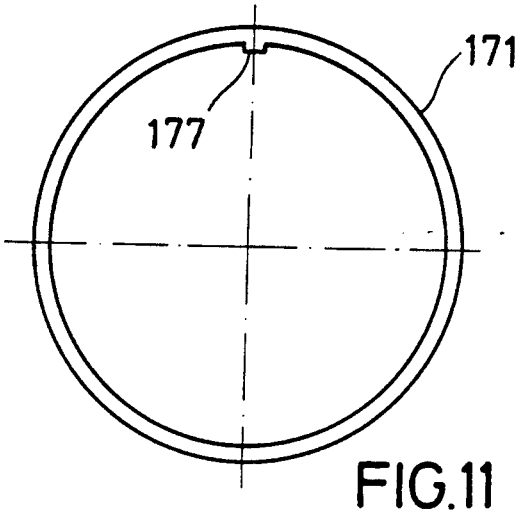
FIG. 11 shows a retainer ring for the takeup reel.
Figure 12:
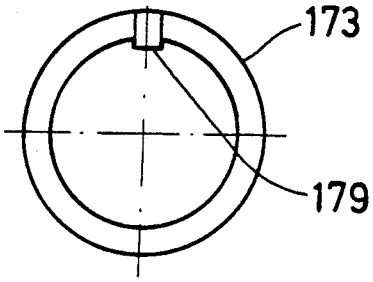
FIG. 12 shows a retainer ring for the supply reel.

Takeup reel 111 and supply reel 105 are adapted to have respective carrier tape bushings 171 and 173 mounted thereon, the latter in particular serving for mounting carrier tape coil 107 thereon. Since carrier tape bushings 171 and 173 have to be rotated in unison with takeup reel 111 and supply reel 105, respectively, outer ring 112 and supply reel 105 are provided adjacent their respective periphery with at least one notch 175, while carrier tape bushings 171 and 173 are provided with corresponding inwards extending projections 177 and 179, respectively, as particularly shown in FIGS. 11 and 12.

With a view to weight reduction supply reel 105 may be of a configuration similar to that of takeup reel 111, with two concentric rings connected to one another by spokes and integrally connected to disc 117 of disc clutch 113. Disc 117 is adapted to receive and to secure in position the steel sheet member 121 particularly depicted in FIGS. 14 and 15. Adjacent its outer periphery steel sheet member 121 is provided with preferably two axially extending projections 181 adapted to be engaged with corresponding notches 182 formed in disc 117 for non-rotatably securing steel sheet member 121 in position thereon.

Gears 163 and 169 cooperate with respective outer gears 183 formed in sidewalls 161 and 159 of casing 153 to act as a first locking means 180. Outer gears 183 are formed in the lower portions of respective elongate holes so as to mesh with gears 163 and 169, respectively, when takeup reel 111 and supply reel 105 are mounted in casing 153.

For use of the described apparatus, casing 153 is initially placed onto lid 149. Since takeup reel 111 and supply reel 105 have to be freely rotatable in operation, housing 145 or lid 149, respectively, is provided with a projecting portion 185 extending between housing wall 147 and the respective casing sidewall 159 or 161 and designed to lift gears 163 and 169, respectively, out of engagement with the associated outer gears 183 as casing 153 is being inserted, so that takeup reel 111 and supply reel 105 are then freely rotatable. This results in the advantage that takeup reel 111 and supply reel 105 are only permitted to be rotated after casing 153 has been safely inserted into housing 145, the subsequent handling of housing 145 permitting the adhesive film to be readily and quickly applied to a substrate. Casing 153 is secured in position from above by transversely extending pins 190.

In order to prevent carrier tape 104 from being advanced in the wrong direction, i.e. in opposition to its feeding direction, a second locking means comprising a pawl 187 is provided on the axially outer side of supply reel 105 as shown in FIG. 16, pawl 187 being engageable with the teeth of gear 169 in a manner permitting the latter to be rotated only in the proper direction.

For the accurate handling of the apparatus there is provided an especially configured applicator 123 as particularly illustrated in FIGS. 17 and 18. A pair of pins inserted through bores 124 and 126 connect the two sidewalls 159 and 161 of casing 153 to one another. In this manner applicator 123, and specifically its applicator lip 125, is fixedly secured in position within casing 153. In order to permit applicator lip 125 to readily and effectively adapt itself to the variable movements of an operator during the application of the adhesive film, applicator 123 is provided with a conical stop projection having a rounded tip for supporting applicator lip 125 in such a manner that it is pivotable thereabout.

FIGS. 19 and 20 illustrate an alternative embodiment of disc clutch 13 or 113, respectively, designed as a ratchet clutch or detent spring clutch 191. A first disc 192 is provided with a spring pawl 193 extending from its periphery in a radial direction. It is of course also possible to provide a plurality of such spring pawls. Spring pawl 193 is engaged with a ratchet wheel 195 formed integrally with a second disc 194. Ratchet wheel 195 projects in the axial direction so as to surround first disc 192 in the manner shown in FIG. 20.

In summary it can be concluded that the invention provides a readily and simply operable compact apparatus for the application of an adhesive film to a substrate, in which an excellent internal stability is achieved by locating the rotatable main components on a common axis, whereby it is also possible to achieve high unwinding and rewinding speeds. Another advantage resulting particularly from the simple operative connection of the rotatable main components is the possibility of a particularly lightweight construction to thereby avoid premature fatigue of an operator during extended use.

I claim:

1. Apparatus for the application to a substrate of an adhesive film adhering prior to its application to a carrier tape wound onto a coil, said apparatus including an applicator by means of which said adhesive film is peeled of said carrier tape moving therepast, and a takeup reel for rewinding said carrier tape downstream of said applicator, said takeup reel being operatively connected to said carrier tape coil, characterized in that the diameter of the still empty takeup reel (11; 111) is at least as great as the greatest possible diameter of said carrier tape coil (7; 107), said takeup reel (11; 111) and said carrier tape coil (7; 107) being disposed on a common axis (9; 109), and said operative connection being formed by a disc clutch (13;113).

2. Apparatus according to claim 1, characterized in that said disc clutch is designed as a friction disc clutch permitting slippage to occur between said carrier tape coil (7; 107) and said takeup reel (11; 111).

3. Apparatus according to claim 1, characterized in that said disc clutch (13; 113) is designed as a ratchet or detent spring clutch (191).

4. Apparatus according to claim 1, characterized in that said disc clutch (13; 113) is designed as a magnetic clutch permitting slippage of said carrier tape coil (7; 107) to occur relative to said takeup reel (11; 111).

5. Apparatus according to claim 4, characterized in that said magnetic clutch is composed of a magnetic sheet portion (19; 119) and a steel sheet portion (21; 121).

6. Apparatus according to claim 1, characterized in that at least one return guide pin (41; 141) is provided for guiding said carrier tape (4; 104) between said applicator (23; 123) and said takeup reel (11; 111).

7. Apparatus according to claim 6, characterized in that it is provided with two return guide pins (141, 142).

8. Apparatus according to claim 7, characterized in that said two return guide pins (141, 142) are disposed at spaced locations above said carrier tape coil (7; 107) and said takeup reel (11; 111).

9. Apparatus according to claim 8, characterized in that the spacing between said return guide pins (141,142) approximately corresponds to the initial diameter of said carrier tape coil (7; 107).

10. Apparatus according to claim 1, characterized in that three return guide pins (27, 29, 31) are provided for guiding said carrier tape (4; 104) between said applicator (23; 123) and said takeup reel (11; 111), said three return guide pins forming two pairs substantially disposed in respective planes extending substantially perpendicular to one another.

11. Apparatus according to claim 7, characterized in that said return guide pins (41; 27,29,31; 141, 142) are disposed at different angles.

12. Apparatus according to claim 6, characterized in that said return guide pin, or pins (41; 27, 29, 31), is or are, respectively, rotatable.

13. Apparatus according to claim 1, characterized in that said applicator (23; 123) is provided with an applicator lip (25; 125) over which said carrier tape (4; 104) is guided.

14. Apparatus according to claim 13, characterized in that said applicator lip (25; 125) is mounted for pivoting at least about the adhesive film feed axis.

15. Apparatus according to claim 14, characterized in that said applicator lip (25; 125) is mounted for pivoting in all directions.

16. Apparatus according to claim 13, characterized in that said applicator lip (25; 125) is provided with lateral tape guide projections (37; 137).

17. Apparatus according to claim 1, characterized in that on both the side of said carrier tape coil and on the side of said take-up reel, a bushing (171, 173) is provided between said take-up reel (11; 111) and a carrier tape coil supply reel (5; 105) adapted to be non-rotatably and releasable engageable therewith.

18. Apparatus according to claim 1, characterized in that a casing (153) is provided for housing said takeup reel (11; 111), said carrier tape coil (7; 107), said operative connection therebetween, and said applicator.

19. Apparatus according to claim 18, characterized in that said casing (153) is pivotably and lockably mounted in a housing (145).

20. Apparatus according to claim 18, characterized in that first locking means (180) is provided for preventing said takeup reel (11) and/or said supply reel (5) from rotating within said casing (153) when said casing is not in its operative position within said housing (145).

21. Apparatus according to claim 20, characterized in that second locking means (187) is provided in said casing (153) for preventing said carrier tape coil (7; 107) from being rotated opposite to the carrier tape feed direction.

22. Apparatus according to claim 10, characterized in that said return guide pins (41; 27, 29, 31; 141, 142) are deposed at different angles.

23. Apparatus according to claim 10, characterized in that said return guide pins (41; 27, 29, 31) are rotatable.

24. A device for applying an adhesive film to a substrate comprising:

a supply reel for unwinding a coil of carrier tape to which the adhesive film adheres;

an applicator for peeling the adhesive film off of the carrier tape moving therepast;

a tape-up reel for rewinding the carrier tape downstream of the applicator;

the supply reel and take-up reel being mounted on the same shaft and being operatively connected to one another by a disc clutch;

the outer diameter of the take-up reel in its empty state being at least as great as the diameter of the coil of carrier tape in its initial unwound state.

25. The device according to claim 24, wherein the disc clutch comprises two friction discs non-rotatably attached to the supply reel and take-up reel, respectively, and designed to permit slippage therebetween.

26. The device according to claim 25, wherein one disc is provided with magnetic sheet member, and the other disc is provided with a steel sheet member.

27. The device according to claim 26, further comprising first, second and third guide pulleys, with the first and second pulleys disposed in a plane substantially perpendicular to the plane wherein the second and third pulleys are disposed, to form along with the applicator a substantially rectangular guide path for the carrier tape.

28. The device according to claim 27, with the guide pulleys disposed at different angles from the shaft of the supply reel and take-up reel.

29. The device according to claim 28, with the applicator having an applicator lip pivotable about the longitudinal axis of the carrier tape feed path and the lip having lateral tape guide projections.

* * * * *